United States Patent [19]

Beaulieu et al.

[11] Patent Number: 4,735,574

[45] Date of Patent: Apr. 5, 1988

[54] ELECTRICAL CONNECTOR FOR MATING WITH INSULATION DISPLACEMENT TERMINALS

[75] Inventors: Laurence A. J. Beaulieu, Kanata; George Debortoli, Ottawa, both of Canada

[73] Assignee: Northern Telecom Limited, Montreal, Canada

[21] Appl. No.: 45,337

[22] Filed: May 4, 1987

[51] Int. Cl.[4] ..... H01R 11/04

[52] U.S. Cl. ..... 439/43; 439/417; 439/507

[58] Field of Search ..... 439/391, 395, 396, 400–404, 439/417–419, 43, 49, 52, 507

[56] References Cited

U.S. PATENT DOCUMENTS 4,212,507 7/1980 Bunnell ..... 439/43

4,221,445 9/1980 Fleischhacker et al. ..... 439/43

*Primary Examiner*—Joseph H. McGlynn

*Attorney, Agent, or Firm*—R. J. Austin

[57] ABSTRACT

An electrical connector for mating with a terminal assembly to complete an electrical connection with an insulation displacement terminal of the terminal assembly is disclosed. The connector comprises a dielectric housing having a latch for releasably latching the connector in a predetermined position on the terminal assembly and a male electrical contact member carried on the housing for insertion into the insulation displacement terminal. The electrical contact member has an inclined lateral surface for intimately contacting a surface of the insulation displacement terminal over an extended area when the housing is latched in its predetermined position on the terminal assembly. The extended area of contact is more resistant to wear and less vulnerable to oxidation than a point or line contact would be, particularly over repeated matings and unmatings of the connector with the terminal assembly. The contact member is coated with a layer of selenium bright tin overplate, to provide wear resistance, over a layer of nickel underplate, to provide surface malleability which permits the contact surface to conform somewhat to the insulation displacement terminal. The connector is useful for patch cords and the like for distribution frames in telephone exchanges.

15 Claims, 6 Drawing Sheets

ELECTRICAL CONNECTOR FOR MATING WITH INSULATION DISPLACEMENT TERMINALS

This invention relates to an electrical connector for mating with a terminal assembly to complete an electrical connection with an insulation displacement terminal of the terminal assembly.

Insulation displacement terminal arrays are commonly used in distribution frames of telephone exchanges. It is frequently necessary to electrically connect a terminal of one terminal array to a selected terminal of another array. This is typically done by connecting an insulated wire to the selected terminal on one array, and bridging the wire to the selected terminal on the other array. This operation requires separates insertion of each end of the wire with an insertion tool, and trimming of the wire to length.

Interruption of such connections for testing purposes requires removal of the wire. It is not generally practical to reconnect the wires once they are disconnected since the insertion tools used require an excess length of wire for reliable operation, and the wires have already been trimmed to length on their first insertion. Consequently, the above steps including the use of new wire must be repeated every time a connection is interrupted for test purposes. This results in inconvenience and consumption of wire.

The present invention seeks to overcome the above problems by providing a connector which can be conveniently and repeatably mated and unmated with insulation displacement terminals without the use of insertion tools and without consumption of wire. This connector may be used on patch cords and the like to complete distribution frame connections of a temporary nature or which require frequent interruption for testing purposes.

Accordingly, the invention provides an electrical connector for mating with a terminal assembly to complete an electrical connection with an insulation displacement terminal of the terminal assembly, the connector comprising:

a dielectric housing having a latching formation for releasably latching the connector in a predetermined position on the terminal assembly; and a male electrical contact member carried by the housing for insertion into the insulation displacement terminal, the contact member having an inclined lateral surface for contacting a surface of the insulation displacement terminal when the connector is latched in its predetermined position on the terminal assembly.

According to another aspect, the invention provides a terminal assembly in combination with an electrical connector for mating with the terminal assembly; the terminal assembly comprising a terminal carrier and an insulation displacement terminal carried on the terminal carrier, the insulation displacement terminal comprising a female electrical contact member having a pair of opposed resilient contact arms; and the connector comprising a dielectric housing having a latching formation for releasably latching the connector in a predetermined position on the terminal assembly and a male electrical contact member for insertion between the opposed contact arms of the female contact member to resiliently spread the contact arms, the male electrical contact member having an inclined lateral contact surface providing intimate surface area contact with one of the contact arms when the connector is latched in its predetermined position on the terminal assembly.

The inclined lateral surface of the male contact member provides intimate surface area contact between the male contact member and the insulation displacement terminal. This surface area contact is more resistant to wear and less vulnerable to oxidation than a point or line contact would be, particularly over repeated matings and unmatings of the connector with the terminal assembly.

Advantageously, the male contact member may have a free end, a first tapered region adjacent the free end for facilitating insertion of the contact member in the insulation displacement terminal, and a second, more gradually tapered region adjacent the first tapered region, the second tapered region including the inclined lateral surface for contact with the insulation displacement terminal. The male contact member may be plated with a hard metallic coating, such as selenium bright tin plate to provide wear resistance, over a softer metallic coating, such as nickel, to provide surface malleability which permits the contact surface to conform somewhat to the insulation displacement terminal.

Embodiments of the invention will now be described, by way of example only, with reference to the accompanying drawings, in which.

Figure 1:
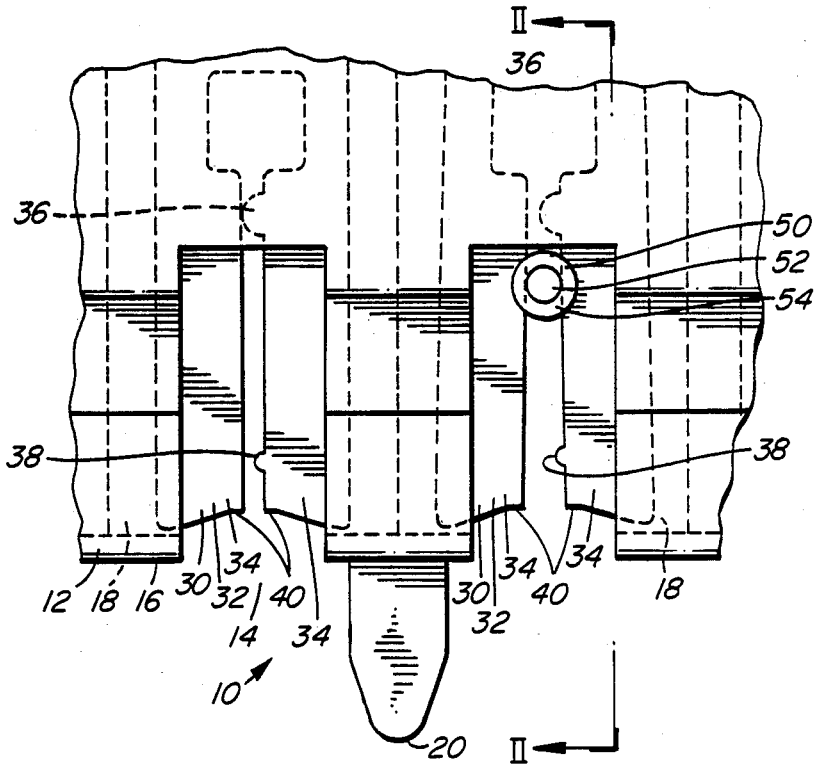
FIG. 1 PRIOR ART
FIG. 1 is a fragmentary plan view of a terminal assembly including a pair of insulation displacement terminals and showing an insulated wire connected to a terminal by conventional techniques.
Figure 2:
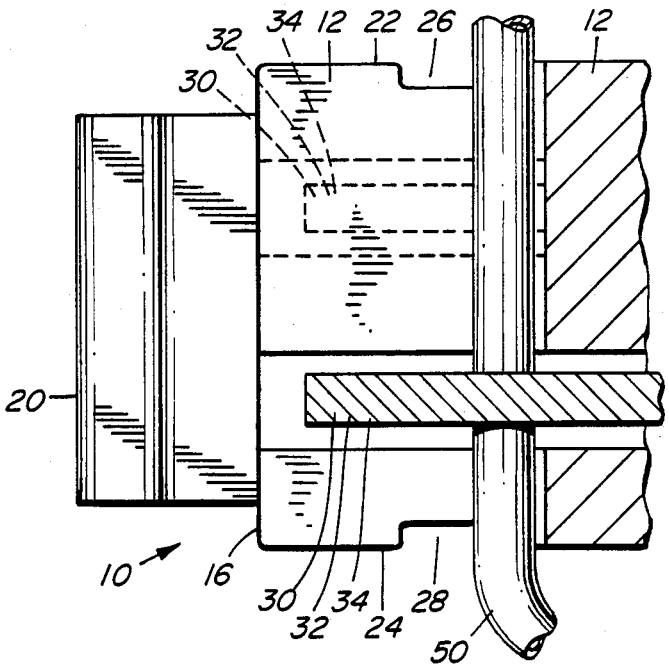
FIG. 2 PRIOR ART
FIG. 2 is a fragmentary cross-sectional view of the terminal assembly of FIG. 1, taken on section line II—II of FIG. 1.

Terminal assemblies, such as the Northern Telecom BIX (Registered Trademark) terminal assembly 10 shown in FIGS. 1 and 2, are commonly used in distribution frames of telephone exchanges.

Each terminal assembly 10 comprises an elongate dielectric terminal carrier 12 having a rectilinear array of vertically extending slots 14 provided in two longitudinally extending edges 16 of the terminal carrier. In the figures, a forward edge 16 only of the carrier 12 is shown. The slots 14 are in pairs, and a finger 20 projects forward between the individual slots of each pair. Upper and lower faces 22, 24 of the terminal carrier 12 include upper and lower longitudinally extending recesses 26, 28 respectively, disposed rearward from the forward edge 16. Each of the recesses 26, 28 is interrupted along its length by the slots 14.

The terminal carrier 12 carries an array of insulation displacement terminals 30, each in a respective cavity 18 of the terminal carrier. Each insulation displacement terminal 30 comprises a metallic female electrical contact member 32 secured to the terminal carrier 12 rearward of a respective one of the slots 14. Each female contact member 32 includes a pair of contact arms 34 which project forward into the respective slot 14. One of the arms 34 includes a preload projection 36 which engages the other arm to spring the arms slightly apart, and a strain relief projection 38 which is located forward of the preload projection and which projects toward the other arm. Each arm 34 also includes a cutting edge 40 at its forward end adjacent the cutting edge of the opposite arm. The arms 34 may be resiliently deflected in opposite lateral directions within the cavity 18 of the terminal carrier.

In the normal use of the insulation displacement terminals 30, an insulated wire is aligned vertically with one of the slots 14 and forced rearward between the arms 34 of the terminal. As the wire passes between the cutting edges 40, the cutting edges penetrate and displace a portion of the insulation of the wire so that the metallic core of the wire makes contact with the arms 34 to complete an electrical connection between the wire and terminal. As the wire is urged rearward between the arms 34, it resiliently deflects the arms laterally apart. The wire is urged rearward beyond the strain relief projection 38 where it is retained between the deflected arms 34 by the resilience of the arms. The strain relief projection 38 also inhibits dislodgement of the wire from the terminal 30. An insulated wire 50 comprising a metallic core 52 surrounded by dielectric insulation 54 is shown connected to the rightmost terminal of FIG. 1. The wire 50 is trimmed adjacent to the upper face 22 of the terminal carrier according to normal practice.

Interruption of such a connection for testing purposes or for altering the connections to the terminal requires removal of the wire. It is not generally practical to reconnect wires once they are disconnected since the wire insertion tools which are commonly used require an excess length of wire for reliable operation, and the wires have already been trimmed to length on their first insertion. Consequently the above steps must be repeated every time a connection is interrupted for test or rearrangement purposes. This results in inconvenience and consumption of wire. Thus, there is a need for connector which can be conveniently and repeatably mated and unmated with insulation displacement terminals for use on patch cords and the like to complete distribution frame connections of a temporary nature of which require frequent interruption for testing purposes.

Figure 3:
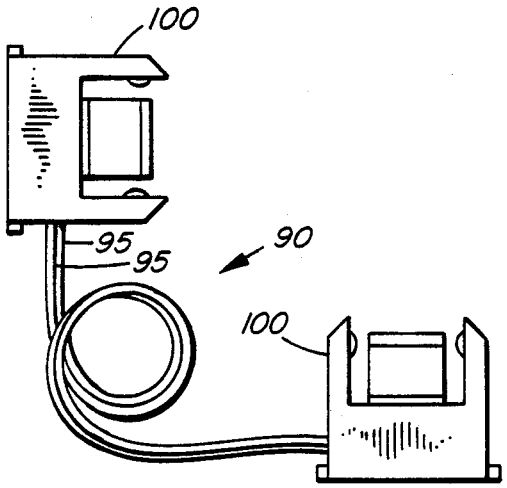
FIG. 3 is an elevational view of a patch cord according to a first embodiment.
Figure 4:
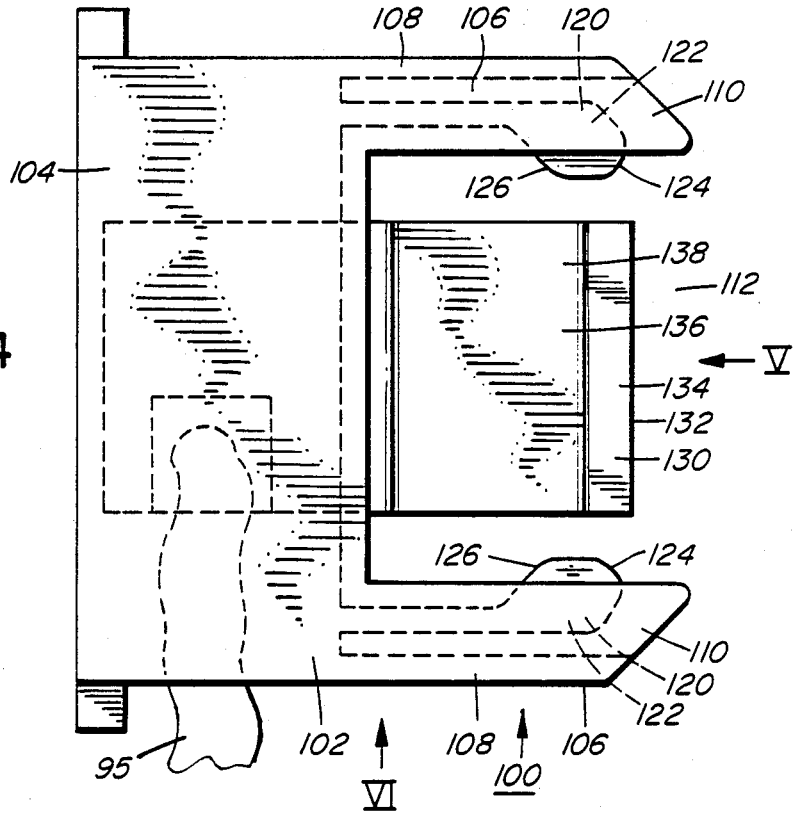
FIG. 4 is an elevational view of a connector of the patch cord of FIG. 3, drawn to a larger scale.
Figure 5:
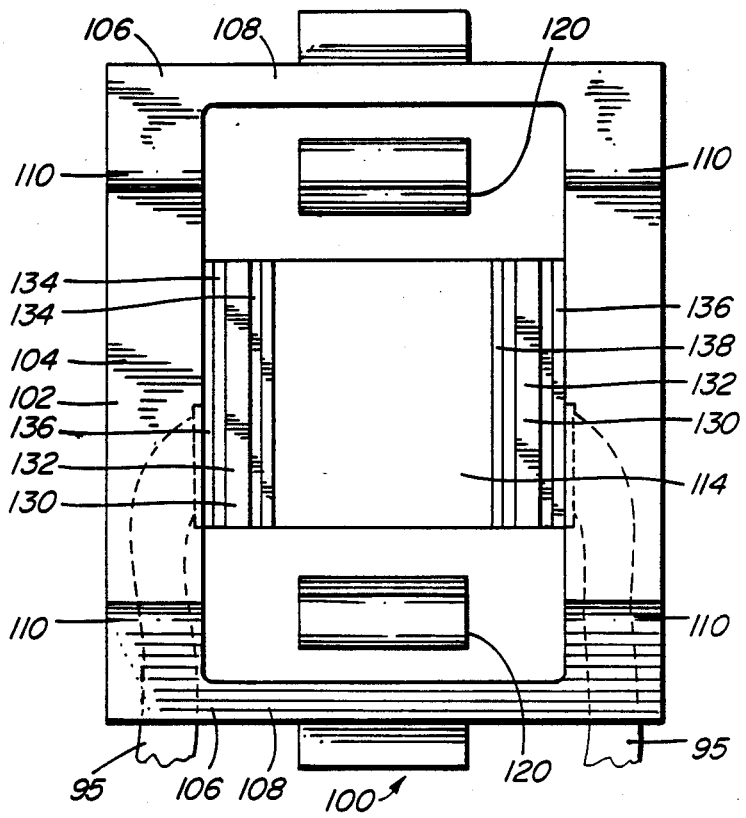
FIG. 5 is an elevational view of the connector of FIG. 4 taken in the direction of arrow V of FIG. 4.
Figure 6:
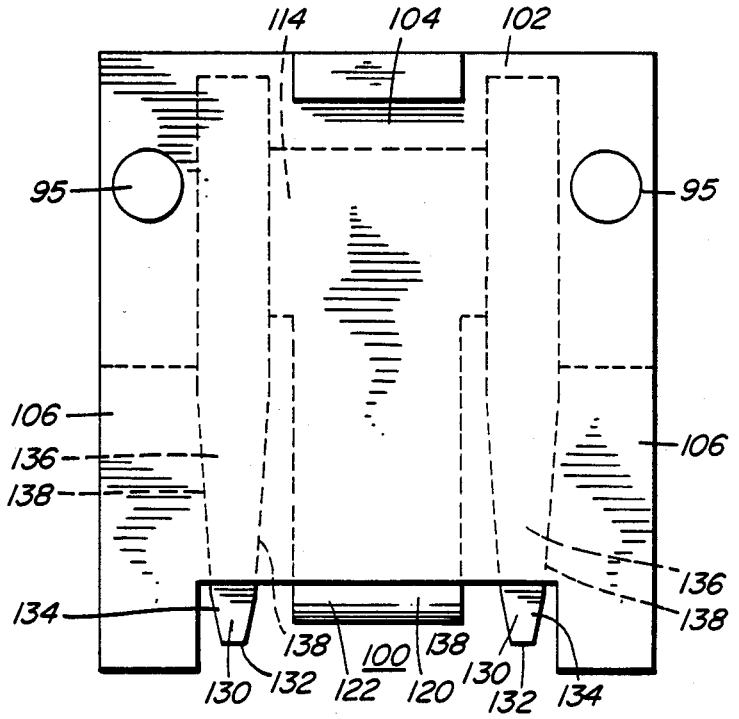
FIG. 6 is an elevational view of the connector of FIG. 4 taken in the direction of arrow VI of FIG. 4.

A patch cord is useful for electrically connecting a selected pair of terminals of one terminal assembly 10 with any selected pair of terminals of another terminal assembly 10. A patch cord 90 constructed according to a first embodiment comprises a pair of flexible insulated conductors 95 terminated at each end of a connector 100, as shown in FIG. 3. Each connector 100, as shown in FIGS. 4, 5 and 6, comprises a dielectric housing in the form of a plastics molding 102. The molding 102 includes a body 104 and two channel members 106 each integrally formed with the body at one end of the channel member and projecting rearwardly from a respective end of the body. Each channel member 106 is U-shaped when viewed from the rear (as shown in FIG. 4) and has an end wall 108 and side walls 110 to open rearwardly and inwardly toward one another. The channel members 106 are spaced apart and, together with the body 104, define a rectangular notch 112, the notch being rearward of the body and between the channel members. The body 104 includes a rearwardly opening recess 114, aligned with the notch 112.

The body 104 carries two latching formations in the form of rearwardly extending latches 120, each latch partially enclosed within and spaced apart from the walls of a respective channel member 106. Each latch 120 is resiliently and integrally connected at its front end to the body 104 and has a head 122 at its rear free end. Each head 122 has first and second inclined camming surfaces 124, 126 which project generally in the direction of and into the notch 112, with camming surface 124 inclined rearwardly and camming surface 126 inclined forwardly relative to the body 104. Each channel member 106 protects its respective latch 120 from mechanical damage.

The body 104 carries two laterally spaced apart male electrical contact members in the form of metallic blades 130 embedded within the body. Each blade 130 projects rearwardly from the body 104 into the notch 112 with the recess 114 disposed between the blades. Thus, the blades 130 are disposed between the latches 120.

Each blade 130 has a free end 132 remote from the body 104, a first tapered region 134 adjacent the free end, and a second, more gradually tapered region 136 adjacent the first tapered region. The second tapered region 136 includes inclined lateral surfaces 138.

The blades 130 are fabricated from phosphor bronze and are plated with a $200\times10^{-6}$ inch $\pm50\times10^{-6}$ inch outer coating of selenium bright tin plate overlying a $200\times10^{-6}$ inch $\pm50\times10^{-6}$ inch inner coating of nickel underplate.

The flexible insulated wires 95 each have an end embedded within the body, the wire being electrically connected each to a respective one of the blades 130.

Figure 7:
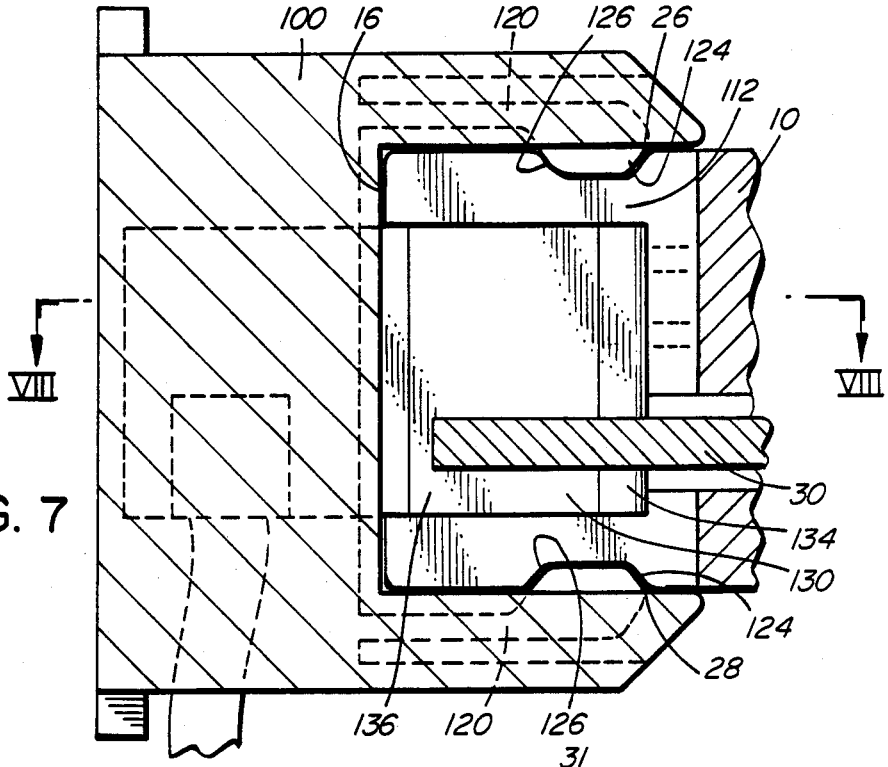
FIG. 7 is a cross-sectional view of the connector of FIG. 4 mounted to the terminal assembly of FIGS. 1 and 2.
Figure 8:
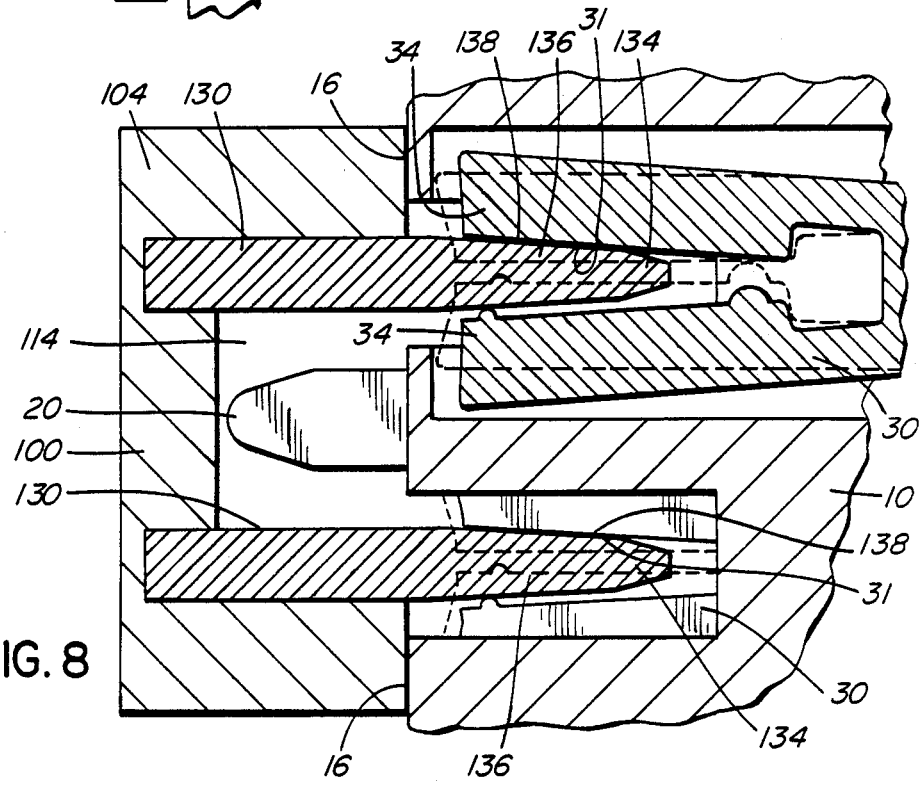
FIG. 8 is a cross-sectional view taken on section line VIII—VIII of FIG. 7.

The connector 100 is mated with the terminal assembly 10 as shown in FIGS. 7 and 8. The connector 100 is positioned with the blades 130 aligned with selected terminals 30 of the terminal assembly 10. The connector 100 is then urged rearward to force the blades 130 between the contact arms 34 of the terminals 30, each blade resiliently spreading a pair of the contact arms from an undeflected position, shown in phantom outline in FIG. 8, to a deflected position shown in full outline in FIG. 8. The first tapered region 134 facilitates entry of each blade 130 into its respective terminal 30.

The finger 30 extends between the blades 130 into the recess 114 until the body 104 at the base of the notch 112 engages the forward edge 16 of the terminal carrier 12 on each side of the finger. The notch 112 cooperates with the forward edge 16 of the terminal carrier 12 to ensure proper placement of the connector 100 on the terminal assembly 10. In addition, the latches 120 of the contact assembly 100 are resiliently deflected each from a normal position relatively close to the blades 130 to a strained position further removed from the blades by a camming action provided by movement of the camming surfaces 124 over the forward edge 16 of the connector 10. As the assembly moves rearwardly, the heads 122 of the latches 120 enter the recesses 26, 28 of the terminal carrier 12 to latch the connector 100 in a predetermined position on the terminal assembly 10. The camming surfaces 126 permit removal of contact assembly from the connector 10.

As shown in FIG. 8, with the connector 100 latched in its predetermined position on the terminal assembly 10, each blade 130 makes electrical contact with a respective one of the insulation displacement terminals 30. The taper of the second tapered region 136 of each blade is arranged so that one of the inclined lateral surfaces 138 intimately contacts a surface area 31 of a contact arm 34 of the terminal 30 when the connector is latched in its predetermined position with negligible play. The surface area of contact between the blade 130 and terminal is more resistant to wear and less vulnerable to oxidation than a point or line contact would be, particularly over repeated matings and unmatings of the contact assembly with the connector. The selenium bright tin overplate provides wear resistance while the softer nickel underplate provides surface malleability to permit the inclined lateral surfaces 138 to conform somewhat to the terminal 30.

Figure 9:
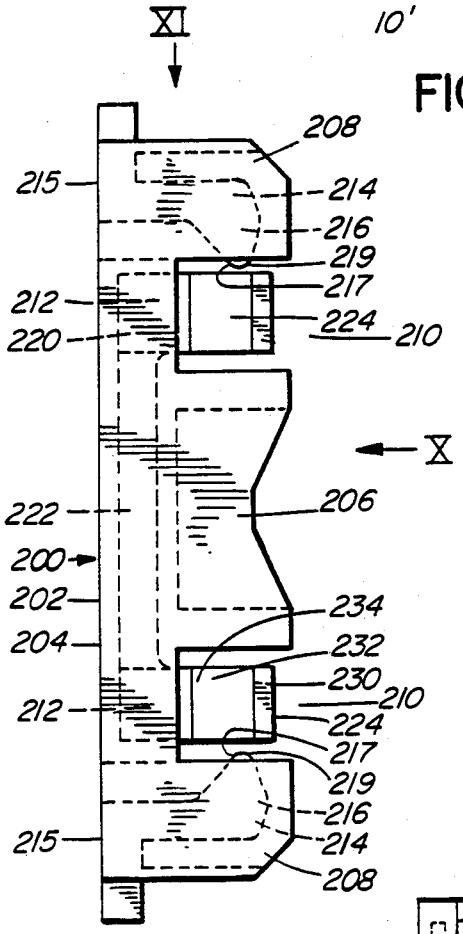
FIG. 9 is a side elevational view of a bridging link according to a second embodiment of the invention drawn to a smaller scale than FIGS. 1 to 8.
Figure 10:
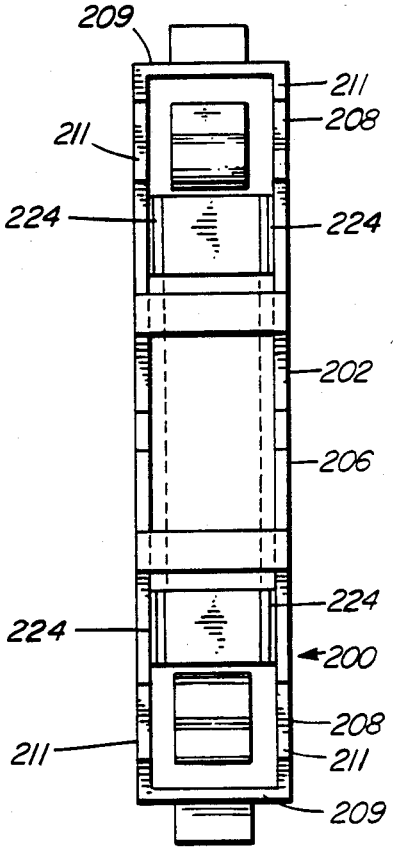
FIG. 10 is a view of the bridging link of FIG. 9 taken in the direction of arrow X in FIG. 9.
Figure 11:
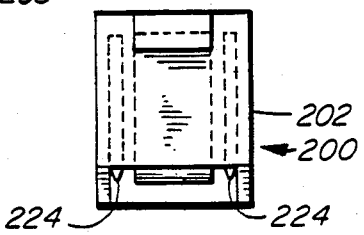
FIG. 11 is a view of the bridging link of FIG. 9 taken in the direction of arrow XI in FIG. 9.

In a second embodiment (FIGS. 9 to 14), an electrical connector is in the form of a bridging link as described in a concurrently filed copending application entitled "Bridging Link for Electrically Connecting Insulation Displacement Terminals" (Case No. 3–16) in the names of L.A.J. Beaulieu and G. Debortoli. The bridging link 200, which is useful for connecting a selected pair of insulation displacement terminals of one terminal assembly to a corresponding pair of terminals on an adjacent terminal assembly, comprises a dielectric housing in the form of a plastics moulding 202 (FIGS. 9, 10 and 11). The moulding 202 comprises an elongate rigid body 204, a central member 206 extending rearwardly from a central region of the body and two channel members 208 similar to the channel members 106 of the first embodiment, each extending rearwardly from a respective end of the body. The central member 206, and channel members 208 are spaced apart and, together with the body 204, define two rectangular notches 210, similar to the notch 112 of the first embodiment, each notch being rearward of the body and between the central member and a respective channel member. The body 204 includes two rearwardly opening recesses 212, similar to the recess 114 of the first embodiment, aligned one with each notch 210.

The body 204 carries two latching formations in the form of rearwardly extending latching 214 similar to the latches 120 of the first embodiment, each latch partially enclosed within and spaced apart from the walls of a respective channel member 208.

The body 204 carries two laterally spaced apart metallic electrically conductive inserts 220 each of which comprise an elongate central part 222 embedded within the body 204, and two metallic blades 224 similar to the blades 130 of the first embodiment at opposite ends of the central part. Each metallic blade 224 projects rearwardly from the body 204 into a respective one of the notches 210. Thus, each notch 210 is occupied by a pair of laterally spaced apart blades 224, like the notch 112 of the first embodiment.

Figure 14:
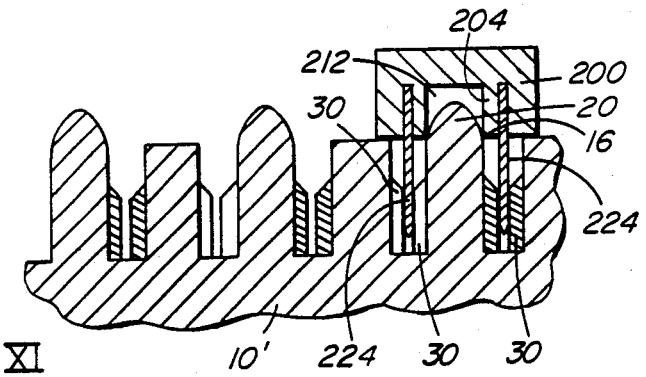
FIG. 14 is a cross-sectional view taken on section line XIV—XIV in FIG. 12.
Figure 13:
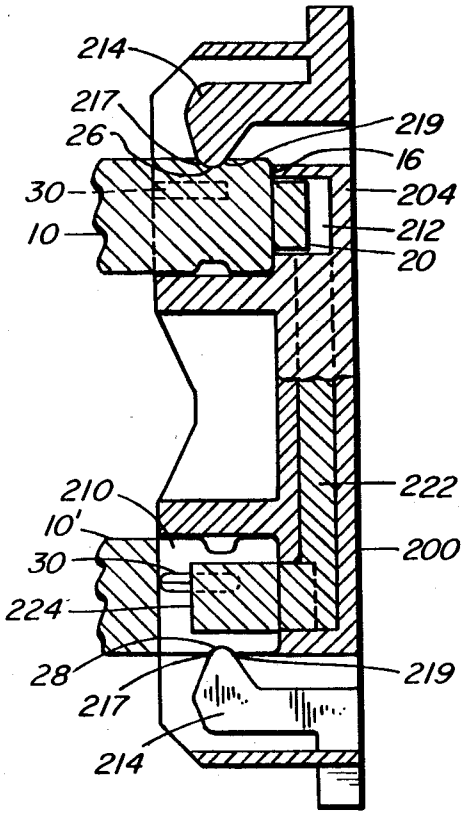
FIG. 13 is a cross-sectional view taken on section line XIII—XIII in FIG. 12.
Figure 12:
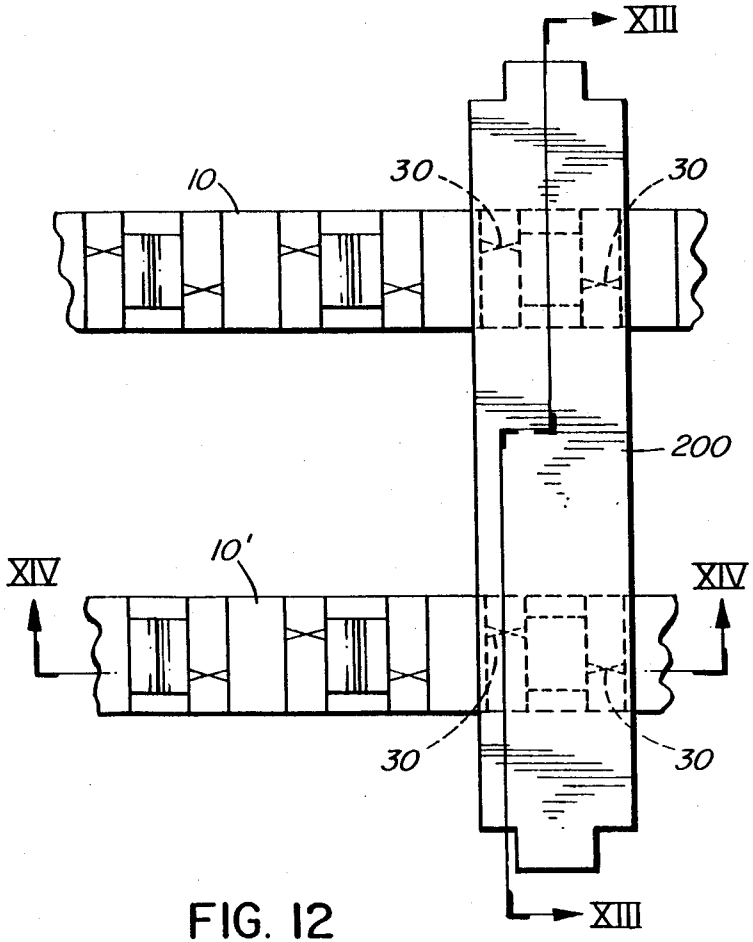
FIG. 12 is a front elevational view of the bridging link of FIG. 9 showing it latched to and bridging between a pair of terminal assemblies.

In the use of the bridging link 200 to electrically connect each of a selected pair of terminals 30 of one terminal assembly 10 to a respective one of a corresponding pair of terminals of an adjacent terminal assembly 10', the bridging link is bridged across the terminal assemblies as shown in FIGS. 11, 12 and 13. One selected pair of terminals is identified on the upper terminal assembly 10. The pair of blades 224 occupying the upper notch 210 is positioned in alignment respectively with the selected terminals 30. This positioning of the upper pair of blades brings the pair of blades 224 occupying the lower notch 210 into alignment with the corresponding pair of terminals 30 on the lower terminal assembly 10'. The bridging link 200 is then urged rearward to force the pairs of blades 224 into respective pairs of terminals 30. As the blades 224 enter the terminals 30, the notches 210 of the bridging link 200 receive respective forward edges 16, of the terminal assemblies 10, 10'. The fingers 20 extend between the blades 224 into the recesses 212 until the body 204 engages the forward edges 16 of each terminal assembly on each side of the particularized finger 20 (FIG. 14). In addition, during rearward movement of the bridging link, the latches 214 of the bridging link 200 are resiliently deflected each from a normal position relatively close to its associated pair of blades 224 to a strained position further removed from said pair of blades by a camming action provided by movement of camming surfaces 217 of the latches 214 over the forward edges 16 of the terminal assemblies. Upon reaching recesses 26 and 28, heads 216 of the latches 214 enter the recesses (FIG. 12) as the latches tend towards their normal unstrained positions to latch the bridging link 200 onto the terminal assemblies 10, 10'. Camming surfaces 219 of the latches 214 permit removal of the bridging link 200 from the terminal assemblies 10, 10'.

The four blades 224 each act as electrical contact members, each making electrical contact with a respective one of the terminals 30. The blades are tapered as in the first embodiment so as to provide intimate contact over a surface area of the insulation terminals, and are coated as in the first embodiment so as to provide wear resistance and surface malleability. The elongate central parts 222 of the metal inserts 220 act as conductive means electrically connecting upper blades 224 to lower blades 224. Thus, the bridging link 200 provides the desired connection between a pair of terminals 30 on one terminal assembly 10 with respective terminals 30 on the other terminal assembly 10'.

The notches 210 of the bridging link 200 cooperate with the forward edges 16 of the terminal assemblies 10, 10' to ensure proper placement of the bridging link on the terminal assemblies. The recesses 212 of the bridging link 200 and the fingers 20 of the terminal assemblies 10, 10' cooperate to act as complementary keying parts to ensure proper placement of the bridging link on the terminal assemblies. The latches 214 of the bridging link 200 and the recesses 26, 28 of the terminal assemblies 10, 10' cooperate to act as complementary latching parts to releasably latch the bridging link onto the terminal assemblies. Thus, the latching action of the bridging link is also similar to the latching action of the first embodiment.

What is claimed is:

1. An electrical connector for mating with a terminal assembly to complete an electrical connection with an insulation displacement terminal of the terminal assembly, the connector comprising:

a dielectric housing having a latching formation for releasably latching the connector in a predetermined position on the terminal assembly; and a male electrical contact member carried by the housing for insertion into the insulation displacement terminal, the contact member having an inclined lateral surface for contacting a surface of the insulation displacement terminal when the connector is latched in its predetermined position on the terminal assembly.

2. A connector as defined in claim 1, wherein the male contact member has a free end, a first tapered region adjacent the free end and a second, more gradually tapered region adjacent the first tapered region, said second tapered region including said inclined lateral surface.

3. A connector as defined in claim 2, wherein the male contact member is plated with an outer metallic coating overlying an inner metallic coating, the inner coating being softer than the outer coating.

4. A connector as defined in claim 3, wherein the male contact member is phosphor bronze, the outer coating is selenium bright tin plate, and the inner coating is nickel underplate.

5. A connector as defined in claim 4, wherein the selenium bright tin plate and nickel underplate are each $200\times10^{-6}$ inches $\pm50\times10^{-6}$ inches thick.

6. A connector as defined in claim 1, comprising a pair of spaced male electrical contact members for insertion into adjacent insulation displacement terminals of the terminal assembly.

7. A connector as defined in claim 6, wherein two latching formations are provided and the pair of male contact members is disposed between the latching formations.

8. A connector as defined in claim 7, wherein each latching formation comprises a latch integrally formed with the housing at a base of the latch and resiliently movable from a normal position relatively close to the pair of male contact members to a strained position further removed from said pair of contact members.

9. A connector as defined in claim 8, wherein each latch has first and second camming surfaces remote from its base with the camming surfaces inclined in opposite directions and projecting towards the pair of male contact members.

10. A connector as defined in claim 9, further comprising a pair of channel members, each channel member at one end being integrally formed with the housing and each channel member extending alongside the male contact members and having an open side facing the pair of male contact members with each channel member partially enclosing an associated one of the latches with the camming surfaces of the latch projecting through the open side of the channel member towards the pair of male contact members.

11. A connector as defined in claim 6, wherein the housing is formed with a notch into which the pair of male contact members extends, said notch provided as a location notch for proper placement of the connector assembly on the terminal assembly.

12. A connector as defined in claim 11, wherein the housing is formed with a recess between the pair of male contact members.

13. A terminal assembly in combination with an electrical connector for mating with the terminal assembly;

the terminal assembly comprising a terminal carrier and an insulation displacement terminal carried on the terminal carrier, the insulation displacement terminal comprising a female electrical contact member having a pair of opposed resilient contact arms; and the connector comprising a dielectric housing having a latching formation for releasably latching the connector in a predetermined position on the terminal assembly and a male electrical contact member for insertion between the opposed contact arms of the female contact member to resiliently spread the contact arms, the male electrical contact member having an inclined lateral contact surface providing intimate surface area contact with one of the contact arms when the connector is latched in its predetermined position on the terminal assembly.

14. A combination as defined in claim 13, wherein the housing is formed with a notch into which the male contact member extends, said notch cooperating with a forward edge of the terminal carrier to guide the connector into its predetermined position on the terminal assembly.

15. A combination as defined in claim 14, wherein the terminal carrier is provided with recesses opening away from the insulation displacement terminal on opposite sides of the insulation displacement terminal, and the connector housing is provided with latching formations on opposite sides of the notch, each latching formation projecting into the notch toward the male contact member and being resiliently deformable away from the male contact member, the latching formations entering the recesses when the connector is latched in its predetermined position on the terminal assembly.

* * * * *